US008177925B2

(12) United States Patent
Takahashi et al.

(10) Patent No.: US 8,177,925 B2
(45) Date of Patent: May 15, 2012

(54) HIGH-TENSILE STEEL PLATE, WELDED STEEL PIPE OR TUBE, AND METHODS OF MANUFACTURING THEREOF

(75) Inventors: Nobuaki Takahashi, Osaka (JP); Masahiko Hamada, Osaka (JP); Shuji Okaguchi, Osaka (JP); Akihiro Yamanaka, Osaka (JP); Ichirou Seta, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 546 days.

(21) Appl. No.: 11/886,423

(22) PCT Filed: Mar. 8, 2006

(86) PCT No.: PCT/JP2006/304452

§ 371 (c)(1),
(2), (4) Date: Aug. 5, 2009

(87) PCT Pub. No.: WO2006/098198

PCT Pub. Date: Sep. 21, 2006

(65) Prior Publication Data

US 2009/0297872 A1 Dec. 3, 2009

(30) Foreign Application Priority Data

Mar. 17, 2005 (JP) ..... 2005-076727

(51) Int. Cl.

| | |
|---|---|
| ***C22C 38/14*** | (2006.01) |
| ***C22C 38/12*** | (2006.01) |
| ***C22C 38/04*** | (2006.01) |
| ***C22C 38/48*** | (2006.01) |
| ***C22C 38/50*** | (2006.01) |
| ***C21D 8/00*** | (2006.01) |
| ***C21D 8/10*** | (2006.01) |
| ***C21D 9/08*** | (2006.01) |

(52) U.S. Cl. ..... 148/336; 148/320; 148/330; 148/331; 148/332; 148/333; 148/334; 148/335; 148/908; 148/541; 148/547; 148/593; 148/654; 164/467; 164/468; 164/499

(58) Field of Classification Search ..... 148/320, 148/330–336, 908, 541, 547, 593, 654; 164/467, 164/468, 499

See application file for complete search history.

(56) References Cited

U.S. PATENT DOCUMENTS

2003/0070786 A1 * 4/2003 Tanaka et al. ..... 164/468

(Continued)

FOREIGN PATENT DOCUMENTS

EP 0 861 915 A1 9/1998

(Continued)

*Primary Examiner* — Deborah Yee
(74) *Attorney, Agent, or Firm* — Clark & Brody

(57) ABSTRACT

In a high-tensile steel plate according to the invention, the carbon equivalent Pcm represented in Expression (1) is from 0.180% to 0.220%, the surface hardness is a Vicker's hardness of 285 or less, the ratio of a Martensite Austenite constituent in the surface layer is not more than 10%, the ratio of a mixed structure of ferrite and bainite inside beyond the surface layer is not less than 90%, the ratio of the bainite in the mixed structure is not less than 10%, the thickness of the lath of bainite is not more than 1 μm, the length of the lath is not more than 20 μm, and the segregation ratio as the ratio of the Mn concentration in the center segregation part relative to the Mn concentration at a part in a depth equal to ¼ of the thickness of the plate from the surface is not more than 1.3. Pcm=C+Si/30+(Mn+Cu+Cr)/20+Ni/60+Mo/15+V/10+5B… (1) where the element symbols in Expression (1) represent the % by mass of the respective elements. In this way, the high-tensile steel plate according to the invention has a yield strength of at least 551 MPa and a tensile strength of at least 620 MPa as well as high toughness, high propagating shear fracture and high weldability.

9 Claims, 2 Drawing Sheets

U.S. PATENT DOCUMENTS

2003/0217795 A1 11/2003 Asahi et al.

FOREIGN PATENT DOCUMENTS

| | | | | |
|---|---|---|---|---|
| EP | 1 995 339 | A1 | | 11/2008 |
| JP | 61-042460 | | * | 8/1984 |
| JP | 2002-220634 | | | 9/2002 |
| JP | 2003-293089 | | | 10/2003 |
| JP | 2003-328080 | | | 11/2003 |
| JP | 2004-043911 | | | 2/2004 |
| JP | 2004-124167 | | | 4/2004 |
| JP | 2004-124168 | | | 4/2004 |
| JP | 2004-131799 | | | 4/2004 |
| JP | 2005-008931 | | | 1/2005 |
| WO | 98/38345 | | | 9/1998 |

* cited by examiner

HIGH-TENSILE STEEL PLATE, WELDED STEEL PIPE OR TUBE, AND METHODS OF MANUFACTURING THEREOF

TECHNICAL FIELD

The present invention relates to a high-tensile steel plate, a welded steel pipe or tube (hereinafter, simply referred to as a pipe) and manufacturing methods thereof, and more particularly to a high-tensile steel plate and a welded steel pipe for use in a line pipe, various kinds of pressure containers, or the like used to transport natural gas or crude oil, and manufacturing methods thereof.

BACKGROUND ART

The pipeline used for transport of natural gas, crude oil or the like over a great distance is desired to have improved transport efficiency. In order to improve the transport efficiency, the operating pressure of the pipeline must be increased, while the strength of the line pipe must be improved corresponding to the increase in the operating pressure.

The pipeline having an increased thickness has higher strength but the increased thickness lowers the welding work efficiency at the operation site. Furthermore, the increased thickness increases the weight of the line pipe accordingly, and therefore lowers the working efficiency at the time of constructing the pipeline. Therefore, approaches to increase the strength of the material of the line pipe itself have been taken rather than increasing the thickness. Today, line pipes having a yield strength of at least 551 MPa and a tensile strength of at least 620 MPa are commercially available, a typical example of which is X80 grade steel standardized by the American Petroleum Institute (API).

By the way, there have been pipeline constructions in progress in cold regions such as in Canada in recent years, and the line pipe used in such a cold region must have high toughness and high propagating shear fracture arrestability. The propagating shear fracture arrestability refers to the capability of arresting a crack if any from further propagating from any brittle fracture caused by a defect inevitably generated at a weld zone.

The line pipe must have good weldability in terms of welding work efficiency.

Therefore, the line pipe must have high strength, high toughness, and high propagating shear fracture arrestability.

JP 2003-328080 A, JP 2004-124167 A, and JP 2004-124168 A disclose steel pipes having high toughness, deformability and strength by the use of a steel pipe base material containing fine carbonitrides having oxide of Mg and Al enclosed therein and composite materials of oxides and sulfides. However, the composite materials of oxides and sulfides should lower the propagating shear fracture arrestability of the steel.

JP 2004-43911 A discloses a line pipe having its low temperature toughness improved by reducing the Si and Al contents in the base material. A method of producing the disclosed line pipe is not specified, and therefore there could be segregation or the crystal grains could be coarse. In such a case, the propagating shear fracture arrestability is lowered.

Another related document is JP 2002-220634 A.

DISCLOSURE OF THE INVENTION

It is an object of the invention to provide a high-tensile steel plate having a yield strength of at least 551 MPa, a tensile strength of at least 620 MPa, high toughness, high propagating shear fracture arrestability, and high weldability and a welded pipe produced using such a high-tensile steel plate.

The inventors have found the following aspects in order to solve the above-described object.

(A) The use of a mixed structure substantially of ferrite and bainite for the metal structure is effective in order to obtain high strength and high toughness. Furthermore, in order to achieve a yield strength of at least 551 MPa and a tensile strength of at least 620 MPa, the ratio of bainite in the mixed structure is not less than 10%.

(B) In order to achieve a yield strength of at least 551 MPa and a tensile strength of at least 620 MPa, and obtain high toughness and weldability, the carbon equivalent Pcm represented by Expression (1) is preferably from 0.180 to 0.220.

$$Pcm=C+Si/30+(Mn+Cu+Cr)/20+Ni/60+Mo/15+V/10+5B \quad (1)$$

where the element symbols in Expression (1) represent the percentages by mass of the respective elements.

(C) High toughness and high propagating shear fracture arrestability may effectively be achieved by refining a packet of bainite and/or refining the grains of cementite in the bainite. More specifically, the thickness of the laths forming the packet is reduced to 1 μm or less and the length of the lath is reduced to 20 μm or less.

(D) The toughness can further be improved by reducing the ratio of the Martensite Austenite constituent (hereinafter simply as "MA") at the surface layer to 10% or less and reducing the surface hardness to a Vickers hardness of 285 or less.

(E) The increase in the Mn content in the steel may improve the tensile strength. However, Mn is an element prone to segregate, and therefore a high Mn content may cause center segregation, so that high propagating shear fracture arrestability cannot be obtained. Unsolidified molten steel in a slab during continuous casting is electromagnetically stirred, and the slab is subjected to reduction before the center of the slab is finally solidified, so that the center segregation can be reduced even if the Mn content is high. Therefore, high strength and high propagating shear fracture arrestability can be obtained.

Based on these findings, the inventors completed the following invention.

A high-tensile steel plate according to the invention includes 0.02% to 0.1% C, at most 0.6% Si, 1.5% to 2.5% Mn, 0.1% to 0.7% Ni, 0.01% to 0.1% Nb, 0.005% to 0.03% Ti, at most 0.1% sol.Al, 0.001% to 0.006% N, 0% to 0.0025% B, 0% to 0.6% Cu, 0% to 0.8% Cr, 0% to 0.6% Mo, 0% to 0.1% V, 0% to 0.006% Ca, 0% to 0.006% Mg, 0% to 0.03% a rare earth element, at most 0.015% P, and at most 0.003% S, the balance consists of Fe and impurities. The high tensile steel plate has a carbon equivalent Pcm in Expression (1) in the range from 0.180% to 0.220%, a surface hardness of at most Vickers hardness of 285, a ratio of a martensite austenite constituent in the surface layer of at most 10%, a ratio of a mixed structure of ferrite and bainite on the inner side beyond the surface layer of at least 90%, and the ratio of the bainite in the mixed structure of at least 10%. A thickness of the lath of the bainite is at most 1 μm, and a length of the lath is at most 20 μm. The high tensile steel plate has a segregation ratio as the ratio of the Mn concentration of a center segregation part to the Mn concentration of a part in a depth equal to ¼ of the thickness of the plate from the surface of at most 1.3.

$$Pcm=C+Si/30+(Mn+Cu+Cr)/20+Ni/60+Mo/15+V/10+5B \quad (1)$$

where the element symbols represent the % by mass of the respective elements.

A high-tensile steel plate according to the invention includes 0.02% to 0.1% C, at most 0.6% Si, 1.5% to 2.5% Mn, 0.1% to 0.7% Ni, 0.01% to 0.1% Nb, 0.005% to 0.03% Ti, at most 0.1% sol.Al, 0.001% to 0.006% N, 0% to 0.0025% B, 0% to 0.6% Cu, 0% to 0.8% Cr, 0% to 0.6% Mo, 0% to 0.1% V, 0% to 0.006% Ca, 0% to 0.006% Mg, 0% to 0.03% a rare earth element, at most 0.015% P, and at most 0.003% S, the balance consists of Fe and impurities. The high tensile steel plate has a carbon equivalent Pcm in the above Expression (1) in the range from 0.180% to 0.220%, a surface hardness of at most Vickers hardness of 285, a ratio of a martensite austenite constituent in the surface layer of at most 10%, a ratio of a mixed structure of ferrite and bainite on the inner side beyond the surface layer of at least 90%, and a ratio of the bainite in the mixed structure of at least 10%. A length of a major axis of cementite precipitate grains in the lath of the bainite is at most 0.5 μm. The high tensile steel plate has a segregation ratio as the ratio of the Mn concentration of a center segregation part to the Mn concentration of a part in a depth equal to ¼ of the thickness of the plate from the surface of at most 1.3.

Preferably, in the high-tensile steel plate, the thickness of the lath is at most 1 μm and the length of the lath is at most 20 μm.

A welded steel pipe according to the invention is produced using the above-described high-tensile steel plate.

A method of manufacturing a high-tensile steel plate according to the invention includes the steps of continuously casting molten steel into a slab, the molten steel includes 0.02% to 0.1% C, at most 0.6% Si, 1.5% to 2.5% Mn, 0.1% to 0.7% Ni, 0.01% to 0.1% Nb, 0.005% to 0.03% Ti, at most 0.1% sol.Al, 0.001% to 0.006% N, 0% to 0.0025% B, 0% to 0.6% Cu, 0% to 0.8% Cr, 0% to 0.6% Mo, 0% to 0.1% V, 0% to 0.006% Ca, 0% to 0.006% Mg, 0% to 0.03% a rare earth element, at most 0.015% P, and at most 0.003% S, the balance consists of Fe and impurities, the molten steel has a carbon equivalent Pcm in the above Expression (1) in the range from 0.180% to 0.220%, and rolling the slab into a high-tensile steel plate. The step of casting includes the steps of injecting the molten steel into a cooled cast and forming a slab having a solidified shell on the surface and unsolidified molten steel inside, drawing the slab downwardly from the cast, reducing the slab by at least 30 mm in the thickness-wise direction in a position upstream of the final solidifying position of the slab where the center solid phase ratio of the slab is more than 0 and less than 0.2, and carrying out electromagnetic stirring to the slab so that the unsolidified molten steel is let to flow in the width-wise direction of the slab in a position at least 2 m upstream of the reducing position. The step of rolling includes the steps of heating the slab in the range from 900° C. to 1200° C., rolling the heated slab into the steel plate so that the cumulative rolling reduction in an austenite no-recrystallization temperature range is in the range from 50% to 90%, and cooling the steel plate at a cooling rate in the range from 10° C./sec to 45° C./sec from a temperature of at least point $A_{r3}$−50° C.

Preferably, the method of manufacturing a high-tensile steel plate further includes the step of tempering the steel plate after the cooling at a temperature less than point $A_{c1}$.

A method of producing a slab for a high-tensile steel plate uses a continuous casting device and includes the steps of injecting molten steel into a cooled cast, thereby forming a slab having a solidified shell on the surface and unsolidified molten steel inside, the molten steel includes 0.02% to 0.1% C, at most 0.6% Si, 1.5% to 2.5% Mn, 0.1% to 0.7% Ni, 0.01% to 0.1% Nb, 0.005% to 0.03% Ti, at most 0.1% sol.Al, 0.001% to 0.006% N, 0% to 0.0025% B, 0% to 0.6% Cu, 0% to 0.8% Cr, 0% to 0.6% Mo, 0% to 0.1% V, 0% to 0.006% Ca, 0% to 0.006% Mg, 0% to 0.03% a rare earth element, at most 0.015% P, and at most 0.003% S, the balance consisting of Fe and impurities, the carbon equivalent Pcm in the above Expression (1) being from 0.180% to 0.220%, drawing the slab downwardly from the cast, reducing the slab by at least 30 mm in the thickness-wise direction in a position upstream of the final solidifying position of the slab where the center solid phase ratio of the slab is more than 0 and less than 0.2, and carrying out electromagnetic stirring to the slab so that the unsolidified molten steel is let to flow in the width-wise direction of the slab in a position at least 2 m upstream of the reducing position.

BEST MODE FOR CARRYING OUT THE INVENTION

Figure 1:
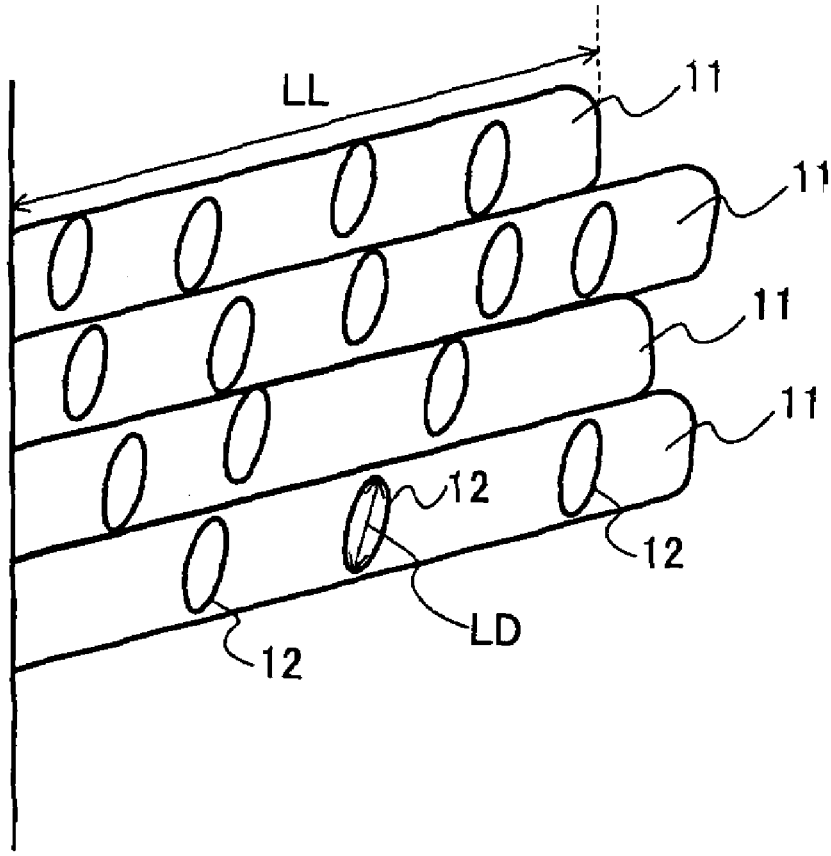
FIG. 1 is a schematic view of a bainite structure in a high-tensile steel according to the invention.

Now, an embodiment of the invention will be described in detail in conjunction with the accompanying drawings in which the same or corresponding portions are denoted by the same reference characters and their description applies to the elements denoted by the same reference characters.

1. Chemical Composition

A high-tensile steel material (a high-tensile steel plate and a welded steel pipe) according to the embodiment of the invention has the following composition. Hereinafter, "%" related to alloy elements means "% by mass."

C: 0.02% to 0.1%

Carbon effectively increases the strength of the steel. However, an excessive C content lowers the toughness and propagating shear fracture arrestability as well as the weldability in a field. Therefore, the C content is from 0.02% to 0.1%, preferably from 0.04% to 0.09%.

Si: 0.6% or less

Silicon effectively deoxidizes the steel. However, an excessive Si content not only degrades the toughness of an HAZ (Heat Affected Zone) but also lowers the workability. Therefore, the Si content is not more than 0.6%, preferably from 0.01% to 0.6%.

Mn: 1.5% to 2.5%

Manganese effectively increases the strength of the steel. However, an excessive Mn content lowers propagating shear fracture arrestability and toughness of the weld zone. An excessive Mn further accelerates center segregation during casting. In order to reduce the center segregation and restrain the propagating shear fracture arrestability and toughness from being lowered, the upper limit for the Mn content is desirably 2.5%. Therefore, the Mn content is from 1.5% to 2.5%, preferably from 1.6% to 2.5%.

Ni: 0.1% to 0.7%

Nickel effectively increases the strength of the steel and improves the toughness and propagating shear fracture arrestability. However, an excessive Ni content saturates these effects. Therefore, the Ni content is from 0.1% to 0.7%, preferably from 0.1% to 0.6%.

Nb: 0.01% to 0.1%

Niobium forms a carbonitride and contributes to refining of austenite crystal grains during rolling. However, an excessive Nb content not only lowers the toughness but also lowers the weldability in the field. Therefore, the Nb content is from 0.01% to 0.1%, preferably 0.01% to 0.06%.

Ti: 0.005% to 0.03%

Titanium combines with N to form TiN and contributes to refining of austenite crystal grains during slab heating and welding. Titanium restrains cracks at the slab surface that would be accelerated by Nb. However, an excessive Ti content may make coarse TiN, which does not contribute to the refining of the austenite crystal grains. Therefore, the Ti content is from 0.005% to 0.03%, preferably from 0.005% to 0.025%.

sol. Al: 0.1% or less

Aluminum effectively deoxidizes the steel. Aluminum also refines the structure and improves the toughness of the steel. However, an excessive Al content may make coarse inclusions, which lowers the. cleanness of the steel. Therefore, the sol. Al content is preferably not more than 0.1%. The sol. Al content is preferably not more than 0.06%, more preferably not more than 0.05%.

N: 0.001% to 0.006%

Nitrogen combines with Ti to form TiN and contributes to refining of austenite crystal grains during slab heating and welding. An excessive N content however degrades the quality of the slab. Furthermore, if the content of N in a solid-solution state is excessive, the toughness of the HAZ is lowered. Therefore, the N content is from 0.001% to 0.006%, preferably from 0.002% to 0.006%.

P: 0.015% or less

Phosphorus is an impurity and not only lowers the toughness of the steel but also accelerates the center segregation of the slab, which causes a brittle fracture at a grain boundary. Therefore, the P content is not more than 0.015%, preferably not more than 0.012%.

S: 0.003% or less

Sulfur is an impurity and lowers the toughness of the steel. More specifically, sulfur combines with Mn to form MnS, and the MnS lowers the toughness of the steel as it is elongated by rolling. Therefore, the S content is not more than 0.003%, preferably not more than 0.0024%.

Note that the balance is Fe, but it may contain impurities other than P or S.

The high-tensile steel material according to the embodiment further contains at least one of B, Cu, Cr, Mo, and V if necessary. More specifically, B, Cu, Cr, Mo, and V are selective elements.

B: 0% to 0.0025%

Cu: 0% to 0.6%

Cr: 0% to 0.8%

Mo: 0% to 0.6%

V: 0% to 0.1%

The above B, Cu, Cr, Mo, and V are elements that effectively increase the strength of the steel. However, if any of these elements is contained excessively, the toughness of the steel is lowered. Therefore, the B content is 0% to 0.0025%, the Cu content is from 0% to 0.6%, the Cr content is from 0% to 0.8%, the Mo content is from 0% to 0.6%, and the V content is from 0% to 0.1%. The B content is preferably 0.0005% to 0.0025%, the Cu content is preferably from 0.2% to 0.6%, the Cr content is preferably from 0.3% to 0.8%, the Mo content is preferably from 0.1% to 0.6%, and the V content is preferably from 0.01% to 0.1%.

The high-tensile steel material according to the embodiment further contains at least one of Ca, Mg, and a rare earth element (REM) if necessary. In other words, Ca, Mg, and REM are selective elements. Calcium, magnesium, and REM are elements used to effectively improve the toughness of the steel.

Ca: 0% to 0.006%

Calcium controls the form of MnS and improves the toughness of the steel in the direction perpendicular to the direction of rolling the steel. However, an excessive Ca content increases non-metal inclusions, which could give rise to internal defects. Therefore, the Ca content is from 0% to 0.006%, preferably from 0.001% to 0.006%.

Mg: 0% to 0.006%

Magnesium controls the form of TiN and restrains coarse TiN from being generated to improve the toughness of the steel and the HAZ. However, an excessive Mg content increases non-metal inclusions, which could give rise to internal defects. Therefore, the Mg content is from 0% to 0.006%, preferably from 0.001% to 0.006%.

REM: 0% to 0.03%

An REM forms an oxide and a sulfide to reduce the amount of O and S in a solid-solution state and improves the toughness of the steel. An excessive REM content however increases non-metal inclusions, which could give rise to internal defects. Therefore, the REM content is from 0% to 0.03%, preferably 0.001% to 0.03%. Note that the REM may be an industrial REM material containing La or Ce as a main constituent.

If two or more elements of Ca, Mg, and REM are contained, the total content of these elements is preferably from 0.001% to 0.03%.

In the high-tensile steel according to the embodiment, the carbon equivalent Pcm in the following Expression (1) is from 0.180% to 0.220%.

$$Pcm=C+Si/30+(Mn+Cu+Cr)/20+Ni/60+Mo/15+V/10+5B \quad (1)$$

where the element symbols represent the % by mass of the respective elements.

The carbon equivalent Pcm is from 0.180% to 0.220%, so that the metal structure becomes a mixed structure of ferrite and bainite. In this way, improved strength and toughness can be provided, and good weldability results.

If the carbon equivalent Pcm is less than 0.180%, sufficient hardenability cannot be provided, which makes it difficult to achieve a yield strength of at least 551 MPa and a tensile strength of at least 620 MPa. On the other hand, if the carbon equivalent Pcm is higher than 0.220%, the hardenability is excessively increased, which lowers the toughness and weldability.

2. Metal Structure 2.1. Structure Excluding Surface Layer

The part of the high-tensile steel material according to the embodiment on the inner side beyond the surface layer is substantially made of a mixed structure of ferrite and bainite. More specifically, the ratio of the mixed structure of ferrite and bainite in the inner side part beyond the surface layer is not less than 90%. Herein, the bainite refers to a structure of lath type bainitic ferrite having cementite grains precipitated inside.

The mixed structure of ferrite and bainite has high strength and high toughness. This is because the bainite formed before the ferrite forms a wall blocking austenite grains, so that the growth of the subsequently forming ferrite is restrained.

In order to obtain higher strength, the ratio of the bainite is preferably higher in the mixed structure of ferrite and bainite. This is because bainite has higher strength than ferrite. In order to achieve a yield strength of at least 551 MPa and a tensile strength of at least 620 MPa, the ratio of bainite in the mixed structure of ferrite and bainite is preferably not less than 10%.

In order to further improve the toughness of the mixed structure of ferrite and bainite, the bainite is preferably generated in a dispersed state. If the aspect ratio of un-recrystallized austenite grains is made 3 or more by hot rolling, bainite can be generated from an austenite grain boundary and numerous nucleation sites in each grain, so that the bainite in the mixed structure can be dispersed. Herein, the aspect ratio refers to a value produced by dividing the length of the major axis of the austenite grain extended in the rolling direction by the length of the minor axis. The bainite can be generated in a dispersed state by the following rolling method.

The above-described ratio (%) of ferrite and bainite can be obtained by the following method. At a cross section of a high-tensile steel plate or a high tensile welded steel pipe, the part at a depth equal to one fourth of the thickness of the plate from the surface (hereinafter referred to as "¼ plate thickness part") is etched by nital or the like, and the etched ¼ plate thickness part is observed in arbitrary 10 to 30 fields (each of which equals to 8 to 24 $mm^2$). A 200-power optical microscope is used for the observation. Since the mixed structure of ferrite and bainite can be recognized by the etching, the area fraction of the mixed structure of ferrite and bainite in each field is measured.

The average of the area fractures of the mixed structure of ferrite and bainite obtained in all the fields (10 to 30 fields) is the ratio of the mixed structure of ferrite and bainite according to the invention. The ratio of bainite in the mixed structure can be obtained in the same manner.

Note that the form of carbide generated in the steel varies depending on the kind of structure (such as ferrite, bainite, and austenite). Therefore, a replica of carbide extracted in each of the fields of the ¼ plate thickness part is observed using a 2000-power electron microscope, so that the ratio of the mixed structure of ferrite and bainite and the ratio of the bainite in the mixed structure may be obtained.

The bainite in the mixed structure of ferrite and bainite further satisfies the following conditions (I) and/or (II).

(I) The thickness of the lath of the bainite is not more than 1 μm, and the length of the lath is not more than 20 μm.

A packet, an aggregation unit of bainite having the same crystal orientation is preferably fine. This is because the length of a crack in a brittle fracture depends on the size of the packet. Therefore, if the packet is reduced in size, the length of the crack can be shortened, and the toughness and propagating shear fracture arrestability can be improved.

The packet consists of a plurality of laths 11 shown in FIG. 1. Therefore, if the length of the lath 11 is not more than 20 μm, high toughness and a good propagating shear fracture arrestability can be secured. In order to obtain such a fine packet, more specifically, to obtain bainite consisting of laths 11 having a length of 20 μm or less, the prior austenite grain size must be adjusted, and the material must be rolled by a cumulative rolling reduction in a prescribed range as will be described.

The thickness of the lath 11 is not more than 1 μm. The thickness of the lath 11 of bainite changes depending on the transformation temperature, and a lath 11 of bainite generated at a higher temperature has a greater thickness. Since bainite having a high transformation temperature cannot obtain high toughness and therefore the thickness of the lath 11 is preferably small. Therefore, the thickness of the lath is not more than 1 μm.

(II) The length of the major axis of the cementite grains in the lath of bainite is not more than 0.5 μm.

As shown in FIG. 1, the lath 11 includes a plurality of cementite grains 12. If the material is gradually cooled from the recrystallized austenite after the rolling, the cementite grains 12 become coarse, and the high propagating shear fracture arrestability cannot be obtained. Therefore, the cementite grains 12 are preferably fine. If the cementite grains 12 have a length of the major axis of 0.5 μm or less, the high propagating shear fracture arrestability can be obtained.

The length of the lath of bainite can be obtained by the following method. The lengths LL of a plurality of laths 11 in FIG. 1 are measured in each of 10 to 30 fields in the ¼ plate thickness part and the average is obtained. The average of the lengths of the laths 11 obtained in all the fields (10 to 30 fields) is the length of the lath according to the invention. The lath length may be measured by observation using an electron microscope based on an extracted replica. The structure in each field may be photographed and then the lath length may be measured based on the photograph.

The thickness of the lath of bainite can be obtained by the following method. A thin film sample of the bainite structure in each of the fields described above is produced, and the produced thin film sample is observed by a transmission electron microscope. The thickness values of the plurality of laths were measured using the transmission electron microscope and the average of the results is obtained. The average of the thickness values of the laths obtained in all the fields is referred to as "lath thickness" according to the invention.

The length of the major axis of the cementite grains can be obtained by the following method. The length of the major axis LD of the plurality of cementite grains 12 shown in FIG. 1 in each of the fields are obtained by observation using the transmission electron microscope based on the above-described thin film sample, and the average of the results is obtained. The average of the length of the major axis obtained in all the fields is produced. The average of the length of the major axis obtained in all the fields is referred to as "the longer diameter of cementite" according to the invention. Note that the length of the major axis LD of the cementite grains 12 shown in FIG. 1 can be measured by observation using an electron microscope based on the above-described extracted replica.

2.2. Structure of Surface Layer

At the surface layer of the high-tensile steel material according to the embodiment, the ratio of the Martensite Austenite constituent (hereinafter simply as MA) in the structure is not more than 10%. Herein, the surface layer refers to a part having a depth equal to 0.5 mm to 2 mm from the descaled surface.

The MA is considered to be generated in the following process. In the step of cooling in the process of manufacturing, bainite and ferrite are produced from austenite. At the time, a carbon element and an alloy element is condensed in the remaining austenite. The austenite excessively containing the carbon and the alloy element is cooled to the room temperature and forms the MA.

The MA is hard and can be an origin of a brittle crack. The MA therefore lowers the toughness and the SSCC resistance. If the MA ratio is not more than 10%, the toughness and the SSCC resistance can be improved.

The MA ratio can be obtained by the following method. The area fraction of the MA is obtained by observation in arbitrary 10 to 30 fields (each of which is from 8 to 24 $mm^2$) at the surface layer using an electron microscope, and the average of the area fractions of the MA obtained in all the fields is produced and the average is the MA ratio according to the invention.

The surface of the high-tensile steel material according to the invention has a Vickers hardness of 285 or less. If the surface hardness is higher than 285 in Vickers hardness, not only the toughness is lowered but also the SCC resistance is lowered. Note that in a welded steel pipe, the surface of any of the base material (BM), the weld zone (WM) and the HAZ has a Vickers hardness of 285 or less, and therefore, high toughness and high SCC resistance can be provided.

The surface hardness can be obtained by the following method. The Vickers hardness is measured at three arbitrary points at a depth of 1 mm from the descaled surface according to JISZ2244. Test force at the measurement is 98.07 N (hardness symbol: HV10). The average of the measurement values is the surface hardness according to the invention.

2.3. Center Segregation

The segregation ratio R of the high-tensile steel material according to the embodiment is not more than 1.3. Herein, the segregation ratio R is the ratio of Mn concentration in the center segregation relative to the Mn concentration in the part substantially without segregation, and it can be represented by the following Expression (2):

$$R = \frac{Mn_{(t/2)}}{Mn_{(t/4)}} \quad (2)$$

where $Mn_{(t/2)}$ is the Mn concentration in the center segregation and the Mn concentration of the center of the thickness of steel plate (or thickness of the steel pipe)(hereinafter referred to as "½ plate thickness part"), $Mn_{(t/4)}$ is the Mn concentration in the part substantially without segregation, and the Mn concentration of a typical example of the part substantially without segregation is that of the ¼ plate thickness part.

When a slab as a material to be rolled by a continuous casting method is produced, segregation is generated in the center of the cross section (center segregation). The center segregation is prone to brittle fractures, and therefore the propagating shear fracture arrestability is lowered. If the segregation ratio R is not more than 1.3, a high propagating shear fracture arrestability can be obtained.

Meanwhile, $Mn_{(t/2)}$ and $Mn_{(t/4)}$ are produced by the following method. A cross section of a steel plate is subjected to macro etching, and a segregation line in the center of the plate thickness is determined. Line analysis using an EPMA is carried out at arbitrary five locations in the segregation line, and the arithmetic mean value of the segregation peak values at the five locations is obtained as $Mn_{(t/2)}$. A sample is taken from the ¼ plate thickness part of the steel plate and the sample is subjected to product analysis according to JISGO321. The resulting Mn concentration is $Mn_{(t/4)}$. The product analysis may be carried out by emission spectroscopy or chemical analysis.

Note that the segregation ratio R never becomes less than 1 in theory but the value could be less than 1 by measurement errors or the like. However, the value never becomes less than 0.9.

2.4. Plate Thickness

If the plate is too thin, it would be difficult to adjust the cooling speed after rolling in the following rolling process. On the other hand, if the plate is too thick, it would be difficult to achieve a yield strength of at least 551 MPa, a tensile strength of at least 620 MPa and a Vickers hardness of at most 285 for the surface hardness. Furthermore, the pipe making process would be difficult. Therefore, the thickness of the high-tensile steel plate according to the invention is preferably from 10 mm to 50 mm.

3. Manufacturing Method

A method of manufacturing a high-tensile steel material according to the embodiment will be described. Molten steel having the above-described chemical composition is formed into a slab by a continuous casting method (the continuous casting process), and the produced slab is then rolled into a high-tensile steel plate (the rolling process). The high-tensile steel plate is further formed into a high tensile welded steel pipe (the pipe making process). Now, these steps will be described in detail.

3.1. Continuous Casting Process

Molten steel refined by a well-known method is produced into a slab by continuous casting. At the time, unsolidified molten steel in the slab is electromagnetically stirred during the continuous casting, and the slab is reduced in the vicinity of the final solidifying position, so that the segregation ratio R is not more than 1.3.

Figure 2:
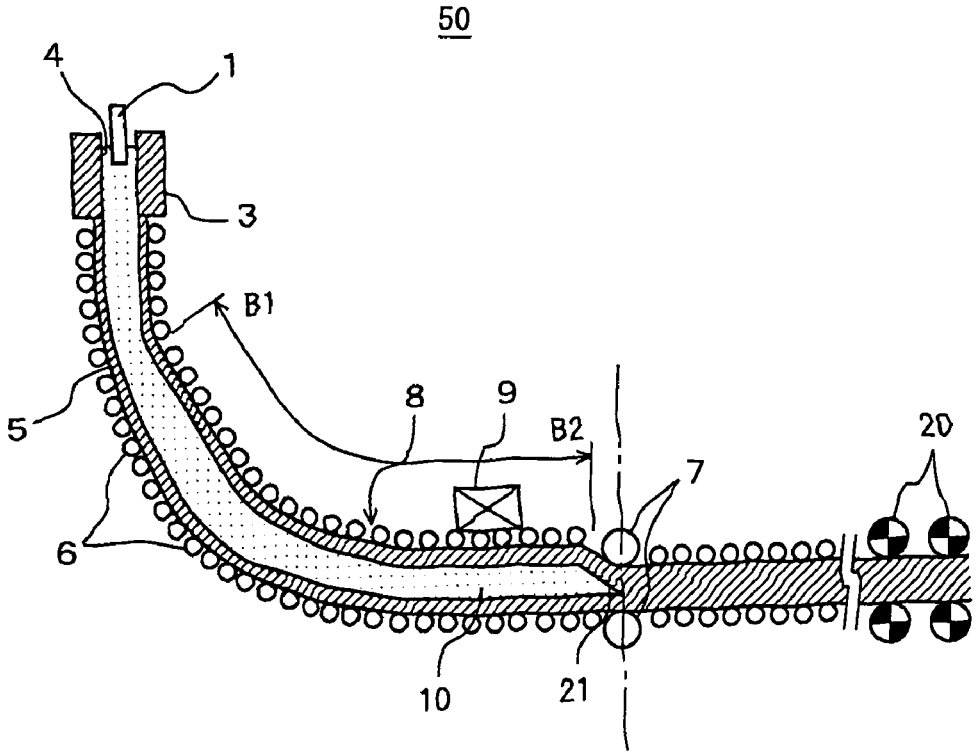
FIG. 2 is a schematic view of a continuous casting device used to manufacture a slab of a high-tensile steel according to the invention.

Referring to FIG. 2, the continuous casting device 50 used in the continuous casting process includes a submerged nozzle 1, a cast 3, support rolls 6 that support a slab in the process of continuous casting, a reducing roll 7, an electromagnetic stirring device 9, and a pinch roll 20.

Refined molten steel is injected into the cast 3 through the submerged nozzle 1. Since the cast 3 has been cooled, the molten steel 4 in the cast 3 is cooled by the inner wall of the cast 3 and forms a solidified shell 5 on the surface.

After the solidified shell 5 is formed, the slab 8 having the solidified shell 5 on the surface and having unsolidified molten steel 10 inside is drawn by the pinch roll 20 at a prescribed casting speed downwardly from the cast 3. At the time, a plurality of support rolls 6 support the slab in the process of drawing. During the drawing, in zones B1 and B2, the slab expands by molten steel static pressure (bulging) but the support rolls 6 serve to prevent excessive bulging.

The electromagnetic stirring device 9 is provided at least 2 m upstream of the position where the slab 8 is reduced by the reducing roll 7. The electromagnetic stirring device 9 electromagnetically stirs the unsolidified molten steel 10 in the slab 8, so that the Mn concentration in the molten steel is homogenized and center segregation is restrained.

The electromagnetic stirring device 9 is positioned at least 2 m upstream of the reducing position because in the position less than 2 m upstream of the reducing roll 7, solidifying already starts inside the slab 8 at the central segregation part, and electromagnetic stirring in the position can hardly homogenize the Mn concentration.

The electromagnetic stirring device 9 allows the unsolidified molten steel 10 to flow in the width-wise direction of the slab 8. At the time, application current is controlled, so that the flow of the unsolidified molten steel 10 is periodically inverted. The direction of the flow of the unsolidified molten steel matches the width-wise direction of the slab, so that the center segregation can further be restrained.

Note that the electromagnetic stirring may be carried out to let the unsolidified molten steel 10 to flow not only in the width-wise direction but also in the thickness-wise direction. In short, it is only necessary that the electromagnetic stirring is carried so that a flow is generated at least in the width-wise direction of the slab.

The above-described electromagnetic stirring device 9 may employ an electromagnet or a permanent magnet.

After the electromagnetic stirring, the reducing roll 7 provided upstream of the final solidifying position reduces the slab 8 in the thickness-wise direction. More specifically, the slab is reduced by 30 mm or more by the reducing roll 7 at the position where the volume fraction of the solid phase of the center of the cross section of the slab 8, i.e., the center solid phase ratio is greater than zero and less than 0.2. In this way, the inner walls of the solidified shell 5 can be adhered under pressure and unsolidified molten steel having concentrated Mn (hereinafter referred to as "concentrated molten steel") 21 in the slab 8 can be discharged toward the upstream side. In this way, the center segregation can be reduced.

If the center solid phase ratio of the slab 8 exceeds 0, the concentrated molten steel 21 that causes center segregation starts to be integrated in the center of the slab 8. If the reduction is carried out in the position where the center solid phase ratio exceeds 0, the concentrated molten steel 21 can effectively be discharged to the upstream side. If the center solid phase ratio is not less than 0.2, the flow resistance of the unsolidified molten steel is excessive, and therefore the concentrated molten steel 21 cannot be discharged by reducing. Therefore, if the slab 8 is reduced in the position where the center solid phase ratio is greater than 0 and less than 0.2, the concentrated molten steel 21 can effectively be discharged, and center segregation can effectively be restrained.

Furthermore, as the reducing amount by the reducing roll 7 is greater, the inner walls of the solidified shell 5 can be adhered more completely. Stated differently, if the reducing amount is smaller, the adhesion of the solidified shell 5 is insufficient, and the concentrated molten steel 21 remains. If the reducing amount is not less than 30 mm, the concentrated molten steel 21 can effectively be discharged and the center segregation ratio R can be not more than 1.3.

By the above-described continuous casting method, a slab having a segregation ratio R of 1.3 or less can be produced. Therefore, a steel plate produced by the following process of rolling also has a segregation ratio R of 1.3 or less. This continuous casting method is effectively applied to a high-tensile steel having an Mn content of more than 1.6%.

Note that in the above-described continuous casting process, the slab is reduced by the reducing roll 7, but the reduction may be carried out by any other method such as forging pressure. The center solid phase ratio is for example calculated by well-known transient heat transfer calculation. The precision of the transient heat transfer calculation is adjusted based on the measurement result of the surface temperature of the slab during casting or the measurement result of the thickness of the solidified shell by riveting.

3.2. Rolling Process

A slab produced by the continuous casting process is heated by a heating furnace, the heated slab is then rolled by a rolling mill and formed into a steel plate, and the steel plate after the rolling is cooled. After the cooling, tempering is carried out if necessary. If the rolling process may be carried out based on the heating condition, the rolling condition, the cooling condition, and the tempering condition as follows, the high-tensile steel plate can be formed to have a structure as described in 2.1 and 2.2. Now, the conditions will be described.

3.2.1. Heating Condition

The heating temperature of the slab in the heating furnace is from 900° C. to 1200° C. If the heating temperature is too high, the austenite grains become too coarse, and the crystal grains cannot be refined. On the other hand, if the heating temperature is too low, Nb that contributes to refining of the crystal grains during the rolling and reinforced precipitin after the rolling cannot be brought into a solid solution state. The heating temperature is set in the range from 900° C. to 1200° C., so that the austenite grains can be restrained from being coarse and Nb can attain a solid solution state.

3.2.2. Rolling Condition

The material temperature during the rolling is in the austenite no-recrystallization temperature range, and the cumulative rolling reduction (%) in the austenite no-recrystallization temperature range is from 50% to 90%. Herein, the austenite no-recrystallization temperature range refers to a temperature range in which a high density dislocation introduced by working like rolling abruptly disappears with the interface movement and specifically corresponds to the temperature range from 975° C. to point $A_{r3}$.

The cumulative rolling reduction (%) is calculated by the following Expression (3):

$$\text{cumulative rolling reduction} = \frac{\text{thickness of material at } 975^\circ\text{ C.} - \text{thickness of material at point } A_{r3}}{\text{thickness of material at } 975^\circ\text{ C.}} \times 100 \quad (3)$$

In order to nucleate bainite from inside austenite grains, disperse the bainite, and restrain the growth of the thus produced bainite, high density transition is necessary. If the cumulative rolling reduction is not less than 50% in the austenite no-recrystallization temperature range, the aspect ratio of the un-recrystallized austenite grains is 3 or more, and high density dislocation structure is produced. Therefore, the bainite can be generated in a dispersed state and the bainite grains can be refined. If however the cumulative rolling reduction exceeds 90%, anisotropy in the mechanical property of the steel becomes significant. Therefore, the cumulative rolling reduction is in the range from 50% to 90%. Preferably, the finishing temperature of rolling is not less than point $A_{r3}$.

3.2.3. Cooling Condition

The temperature of the steel plate at the start of cooling is at point $A_{r3}$−50° C. or more, and the cooling rate is from 10° C./sec to 45° C./sec. If the steel plate temperature at the start of cooling is less than point $A_{r3}$−50° C., coarse bainite is generated, which lowers the strength and toughness of the steel. Therefore, the cooling start temperature is not less than point $A_{r3}$−50° C.

If the cooling rate is too low, the mixed structure of ferrite and bainite cannot be generated sufficiently. The ratio of the bainite in the mixed structure is lowered, and the cementite grains become coarse. Therefore, the cooling rate is not less than 10° C./sec. On the other hand, if the cooling rate is too high, the MA ratio on the surface layer of the steel plate increases, and the surface hardness is excessively raised. Therefore, the cooling rate is not more than 45° C./sec. An example of the cooling method is cooling by water.

When the steel plate temperature is in the range from 300° C. to 500° C., the cooling at the above-described cooling rate is preferably stopped, followed by air cooling. In this way, the toughness may be improved by the effect of tempering during the air cooling and hydrogen induced defects can be restrained.

3.2.4. Tempering Condition

After the cooling, tempering is carried out at less than point $A_{c1}$ if necessary. If for example the surface hardness or toughness must be adjusted, tempering is carried out. Note that the tempering is not critical process and therefore the tempering process does not have to be carried out.

3.3. Pipe Making Step

The high-tensile steel pipe produced by the above-described rolling process is formed into an open-seam pipe by using an U-ing press, an O-ing press and the like. Then, both lengthwise end surfaces of the open-seam pipe are welded using a well-known welding material by a well-known welding method such as submerged arc welding, and a welded steel pipe is produced. The welded steel pipe after the welding is subjected to quenching and to tempering as well if necessary.

EXAMPLE 1

Molten steel having a chemical composition shown in Table 1 was produced.

TABLE 1

| steel | chemical composition (the balance consisting of Fe and inevitable impurities) (% by mass) | | | | | | | | | | |
|---|---|---|---|---|---|---|---|---|---|---|---|
| No. | C | Si | Mn | P | S | Ni | Ti | Nb | sol. Al | N | Cu |
| 1 | 0.07 | 0.25 | 2.05 | 0.009 | 0.001 | 0.30 | 0.010 | 0.035 | 0.038 | 0.0040 | — |
| 2 | 0.06 | 0.15 | 2.00 | 0.011 | 0.002 | 0.45 | 0.016 | 0.033 | 0.041 | 0.0050 | — |
| 3 | 0.09 | 0.05 | 2.20 | 0.004 | 0.001 | 0.45 | 0.016 | 0.035 | 0.034 | 0.0029 | — |
| 4 | 0.06 | 0.13 | 2.00 | 0.09 | 0.001 | 0.15 | 0.010 | 0.035 | 0.038 | 0.0052 | 0.15 |
| 5 | 0.06 | 0.08 | 1.80 | 0.09 | 0.001 | 0.16 | 0.014 | 0.04 | 0.035 | 0.0038 | 0.15 |
| 6 | 0.1 | 0.15 | 1.40 | 0.01 | 0.002 | 0.32 | 0.015 | 0.028 | 0.037 | 0.0036 | — |
| 7 | 0.08 | 0.23 | 2.60 | 0.01 | 0.002 | 0.25 | 0.015 | 0.030 | 0.035 | 0.0034 | — |
| 8 | 0.05 | 0.21 | 1.50 | 0.02 | 0.001 | 0.40 | 0.014 | 0.025 | 0.036 | 0.0044 | — |
| 9 | 0.08 | 0.13 | 2.40 | 0.09 | 0.001 | 0.18 | 0.015 | 0.043 | 0.041 | 0.0046 | 0.23 |
| 10 | 0.05 | 0.13 | 1.62 | 0.09 | 0.001 | 0.12 | 0.010 | 0.043 | 0.041 | 0.0046 | 0.12 |

| steel | chemical composition (the balance consisting of Fe and inevitable impurities) (% by mass) | | | | | | | |
|---|---|---|---|---|---|---|---|---|
| No. | Cr | Mo | V | B | Ca | Mg | REM | Pcm |
| 1 | — | — | — | — | — | — | — | 0.186 |
| 2 | — | — | — | — | — | — | — | 0.181 |
| 3 | — | — | — | — | — | — | — | 0.218 |
| 4 | 0.15 | 0.2 | 0.045 | 0.0001 | — | — | — | 0.200 |
| 5 | 0.15 | 0.15 | 0.04 | 0.0001 | 0.0018 | 0.002 | 0.0001 | 0.185 |
| 6 | — | — | — | — | — | — | — | 0.180 |
| 7 | — | — | — | — | — | — | — | 0.222 |
| 8 | — | — | — | — | — | — | — | 0.139 |
| 9 | 0.25 | 0.35 | 0.037 | 0.0001 | — | — | — | 0.259 |
| 10 | 0.15 | 0.01 | 0.045 | 0.001 | — | — | — | 0.161 |

Underlined numerals are outside the range defined by the invention

The Pcm column in Table 1 represents the Pcm of each kind of steel obtained from Expression (1). Steel samples 1 to 5 all had a chemical composition and Pcm within the ranges of the invention. Meanwhile, steel samples 6 to 10 all had a chemical composition and Pcm outside the ranges of the invention. More specifically, the Mn content of steel sample 6 was less than the lower limit according to the invention. Steel samples 7 and 9 had chemical compositions within the range of the invention but Pcm exceeding the upper limit according to the invention. Steel samples 8 and 10 had chemical compositions within the range of the invention but Pcm less than the lower limit according to the invention.

A slab was produced by subjecting molten steel in Table 1 to continuous casting in the casting condition shown in Table 2, and the produced slab was rolled into a steel plate as thick as 20 mm in the rolling condition shown in Table 3. More specifically, steel plates of test Nos. 1 to 24 were produced in the manufacturing condition (combinations of steel, casting conditions and rolling conditions) shown in Table 4.

TABLE 2

| casting condition No. | center solid phase ratio | inline rolling reduction (mm) |
|---|---|---|
| 1 | 0.05 | 35 |
| 2 | 0.19 | 31 |
| 3 | 0.22 | 35 |
| 4 | 0 | 35 |
| 5 | 0.12 | 24 |

Underlined numerals are outside the range defined by the invention.

TABLE 3

| rolling condition No. | heating temperature (° C.) | cumulative rolling reduction (%) | finishing temperature (° C.) | cooling start temperature (° C.) | cooling rate (° C./sec) | tempering temperature (° C.) |
|---|---|---|---|---|---|---|
| 1 | 1120 | 75 | 830 | 800 | 25.3 | — |
| 2 | 1120 | 88 | 820 | 780 | 18.2 | — |
| 3 | 1120 | 51 | 820 | 780 | 11.8 | — |
| 4 | 1120 | 75 | 820 | 680 | 19.5 | — |
| 5 | 1120 | 75 | 820 | 780 | 44.2 | — |
| 6 | 1120 | 75 | 820 | 780 | 10.2 | — |
| 7 | 1120 | 75 | 820 | 780 | 19.4 | 550 |
| 8 | 1140 | 75 | 800 | 640 | 20.4 | — |
| 9 | 1140 | 75 | 850 | 820 | 48.1 | — |
| 10 | 1120 | 75 | 810 | 780 | 8.4 | — |
| 11 | 1160 | 93 | 790 | 760 | 24.8 | — |
| 12 | 1140 | 50 | 680 | 640 | 17.8 | — |

Underlined numerals are outside the range defined by the invention.

TABLE 4

| | | manufacturing condition | | | | structure | | | |
|---|---|---|---|---|---|---|---|---|---|
| | test No. | steel No. | casting condition No. | rolling condition No. | R | MA ratio (%) | mixed structure ratio (%) | bainite ratio in mixed structure (%) | bainite lath thickness (μm) |
| inventive steel | 1 | 1 | 1 | 1 | 1.1 | 2 | 95 | 65 | 0.3 |
| | 2 | 2 | 1 | 1 | 1.1 | 2 | 95 | 67 | 0.3 |
| | 3 | 3 | 1 | 1 | 1.1 | 3 | 95 | 72 | 0.3 |
| | 4 | 1 | 2 | 2 | 1.1 | 3 | 95 | 71 | 0.3 |
| | 5 | 1 | 1 | 3 | 1.1 | 2 | 91 | 52 | 1.1 |
| | 6 | 1 | 1 | 4 | 1.1 | 2 | 92 | 52 | 0.8 |
| | 7 | 1 | 1 | 5 | 1.1 | 9 | 90 | 80 | 0.2 |
| | 8 | 1 | 1 | 6 | 1.1 | 1 | 91 | 38 | 0.8 |
| | 9 | 1 | 1 | 7 | 1.1 | 2 | 95 | 65 | 0.3 |
| | 10 | 4 | 1 | 1 | 1.1 | 3 | 92 | 86 | 0.4 |
| | 11 | 5 | 1 | 1 | 1.1 | 2 | 90 | 73 | 0.3 |
| comparative steel | 12 | 1 | 3 | 1 | 1.5 | 3 | 93 | 70 | 0.5 |
| | 13 | 1 | 4 | 1 | 1.4 | 3 | 97 | 73 | 0.4 |
| | 14 | 1 | 5 | 1 | 1.5 | 4 | 93 | 80 | 0.5 |
| | 15 | 1 | 1 | 8 | 1.1 | 4 | 91 | 19 | 0.4 |
| | 16 | 1 | 1 | 9 | 1.1 | 12 | 75 | 80 | 0.3 |
| | 17 | 1 | 1 | 10 | 1.1 | 1 | 95 | 5 | 0.5 |
| | 18 | 1 | 1 | 11 | 1.2 | 2 | 92 | 9 | 0.3 |
| | 19 | 1 | 1 | 12 | 1.1 | 3 | 93 | 20 | 1.2 |
| | 20 | 6 | 1 | 1 | 1.0 | 1 | 93 | 35 | 1.2 |
| | 21 | 7 | 1 | 1 | 1.1 | 7 | 82 | 90 | 0.3 |
| | 22 | 8 | 1 | 1 | 1.1 | 2 | 93 | 28 | 1.1 |
| | 23 | 9 | 1 | 1 | 1.1 | 5 | 94 | 90 | 0.3 |
| | 24 | 10 | 1 | 1 | 1.1 | 3 | 93 | 45 | 0.9 |

| | | structure | | | | | | | |
|---|---|---|---|---|---|---|---|---|---|
| | test No. | bainite lath length (μm) | Length of major axis of cementite grain (μm) | YS (MPa) | TS (MPa) | vE-20 (J) | DWTT 85% FATT | hardness (Hv) | weld-ability |
| inventive steel | 1 | 12 | 0.1 | 582 | 678 | 184 | −22 | 248 | ○ |
| | 2 | 15 | 0.2 | 633 | 685 | 203 | −28 | 262 | ○ |
| | 3 | 14 | 0.1 | 632 | 756 | 161 | −20 | 277 | ○ |
| | 4 | 10 | 0.1 | 643 | 692 | 246 | −42 | 265 | ○ |
| | 5 | 19 | 0.3 | 552 | 624 | 280 | −35 | 255 | ○ |
| | 6 | 18 | 0.3 | 553 | 634 | 269 | −44 | 236 | ○ |
| | 7 | 8 | 0.1 | 689 | 764 | 255 | −31 | 278 | ○ |
| | 8 | 18 | 0.6 | 551 | 627 | 288 | −42 | 225 | ○ |
| | 9 | 12 | 0.3 | 644 | 681 | 245 | −29 | 240 | ○ |
| | 10 | 15 | 0.1 | 624 | 783 | 189 | −28 | 233 | ○ |
| | 11 | 15 | 0.1 | 601 | 700 | 381 | −58 | 239 | ○ |
| comparative steel | 12 | 15 | 0.1 | 551 | 645 | 144 | −17 | 212 | ○ |
| | 13 | 12 | 0.1 | 552 | 652 | 142 | −16 | 208 | ○ |
| | 14 | 17 | 0.1 | 567 | 666 | 145 | −8 | 213 | ○ |
| | 15 | 22 | 0.6 | 520 | 634 | 312 | −59 | 221 | ○ |
| | 16 | 16 | 0.1 | 678 | 869 | 127 | −11 | 302 | ○ |
| | 17 | 15 | 0.6 | 448 | 602 | 234 | −21 | 223 | ○ |
| | 18 | 22 | 0.6 | 515 | 648 | 179 | −28 | 232 | ○ |
| | 19 | 25 | 0.6 | 501 | 648 | 232 | −29 | 233 | ○ |
| | 20 | 18 | 0.5 | 488 | 568 | 305 | −55 | 185 | ○ |
| | 21 | 11 | 0.1 | 765 | 826 | 258 | −33 | 292 | X |
| | 22 | 14 | 0.1 | 480 | 552 | 258 | −44 | 202 | ○ |
| | 23 | 11 | 0.1 | 751 | 856 | 178 | −21 | 301 | X |
| | 24 | 15 | 0.6 | 523 | 601 | 222 | −49 | 199 | ○ |

Underlined numerals are outside the range defined by the invention.

In the continuous casting process, a continuous casting device having the structure shown in FIG. 2 was used. Note that the electromagnetic stirring device 9 was positioned at least 2 m upstream of the roll reduction position. Electromagnetic stirring was carried out so that unsolidified molten steel was let to flow in the width-wise direction of the slab. Note that "center solid phase ratio" in Table 2 represents the center solid phase ratio of the slab during the roll reduction and the "inline rolling reduction" refers to the rolling reduction (mm) at the time of roll reduction.

The "heating temperature" in Table 3 represents the heating temperature of the slab (° C.), and the "cumulative rolling reduction" represents the cumulative rolling reduction (%) obtained by Expression (3). The "finishing temperature" is the finishing temperature (° C.) for rolling, the "water-cooling start temperature" and "cooling rate" are the temperature (° C.) at the start of cooling after the rolling and the cooling rate (° C./sec) during the cooling. According to the embodiment, the steel plate was cooled by water. Note that Test No. 11 in Table 4 was tempered after the cooling at the tempering temperature shown in Table 3.

The produced steel plates were measured for the MA ratio of the surface layer, the ratio of the mixed structure of ferrite and bainite, the bainite ratio in the mixed structure, the thickness and length of the lath of bainite, and the length of the major axis of the cementite grains in the bainite according to the methods described in 2.1. and 2.2. The segregation ratio R was obtained by the method described in 2.3. The results are given in Table 4.

Furthermore, the steel plates were examined for the mechanical properties (the tensile strength, the toughness, the propagating shear fracture arrestability, and the surface hardness) and the weldability by the following methods.

The tensile strength was obtained by tensile test using a plate test piece according to the API standard. The toughness and propagating shear fracture arrestability were obtained by a 2 mm V-notch Charpy impact test and a DWTT (Drop Weight Tear test). In the Charpy impact test, a JIS Z2202 4 test piece was produced from each steel plate, and tests were carried out according to JIS Z2242 to measure absorbed energy at −20° C.

In the DWTT, a test piece was processed according to API standard. At the time, the test piece was as thick as the original (i.e., 20 mm), and provided with a press notch. The test piece was provided with an impact load by pendulum falling and the surface of the test piece fractured by the impact load was observed. The test temperature at which at least 85% of the fractured surface was a ductile fracture was obtained as an FATT (Fracture Appearance Transition Temperature). Note that in the DWTT, a brittle crack was generated from the notch bottom from all the test pieces. The surface hardness was obtained by the method described in 2.2.

A y-slit type weld cracking test was carried out according to JIS Z 3158, and the weldability was evaluated based on the presence/absence of a crack. Note that in the test, welding was carried out by arc welding with a heat input of 17 kJ/cm without pre-heating.

Examination Results

The results of examination are given in Table 4. In the table, "TS (MPa)" is tensile strength, "vE-20(J)" is absorbed energy at −20° C., "85% FATT (° C.)" is a transition temperature obtained by the DWTT, and the hardness (Hv) is a Vickers hardness on the surface of each steel plate. In the table, "O" in the "weldability" column represents the absence of a crack in the y-type weld crack test, and "x" represents the presence of a crack.

Referring to Table 4, test Nos. 1 to 11 each had a chemical composition and a manufacturing condition within the ranges of the invention, and therefore their structures are within the range of the invention. They all have a yield strength of at least 551 MPa and a tensile strength of at least 620 MPa. The absorbed energy (vE-20) was 160 J or more and FATT was −20° C. or less for the steel plates with all the test numbers, which indicates high toughness and high propagating shear fracture arrestability. The steel plates all had a Vickers hardness of 285 or less for the surface hardness and therefore a high SCC resistance was suggested. Furthermore, there was no weld crack and high weldability was shown.

Note that steel plates of test Nos. 10 and 11 contained Cu, Cr, Mo, V, and B and therefore had higher tensile strengths than the steel plates of the other test Nos. 1 to 9. Test No. 11 contained Ca, Mg, and REM and therefore had higher toughness and higher propagating shear fracture arrestability than the other steel plates of test Nos. 1 to 10. More specifically, the steel plate of test No. 11 had a higher absorbed energy and a lower FATT as than those of the steel plates of test Nos. 1 to 10.

For test Nos. 12 to 24, at least one of the strength, the toughness, the propagating shear fracture arrestability, the surface hardness and the weldability was poor.

Test Nos. 12 to 14 each had a chemical composition and Pcm in the ranges according to the invention but a casting condition outside the range according to the invention and therefore the toughness and/or the propagating shear fracture arrestability was poor. More specifically, test No. 12 had a center solid phase ratio in inline reduction during the continuous casting exceeded 0.20, the upper limit according to the invention, and therefore the segregation ratio R exceeded 1.3. Therefore, the absorbed energy is less than 160 J, and the FATT was higher than −20° C. Test No. 13 had a center solid phase ratio of zero during inline reduction, and therefore the center segregation ratio R exceeded 1.3. Therefore, the absorbed energy was less than 160 J and the FATT was higher than −20° C. Test No. 14 had a center segregation ratio R exceeding 1.3 and an FATT exceeding −20° C. because the rolling reduction during the inline reducing was small.

Test Nos. 15 to 19 each had a chemical composition, Pcm, and a casting condition within the ranges according to the invention but a rolling condition outside the range according to the invention and therefore desired mechanical properties were not provided. More specifically, test No. 15 had a cooling start temperature lower than point $A_{r3}$−50° C., and therefore coarse bainite and cementite were generated. Therefore, the yield strength was less than 551 MPa. Test No. 16 had a cooling rate exceeding 45° C./sec, and therefore the MA ratio exceeded 10% and the ratio of the mixed structure of ferrite and bainite was less than 90%. The surface toughness was more than 285 Hv. Therefore, the absorbed energy was less than 160 J and the FATT was higher than −20° C.

Test No. 17 had a cooling rate of less than 10° C./sec, so that the bainite ratio in the mixed structure was less than 10% and the length of the major axis of the cementite grains was more than 0.5 μm. Therefore, the yield strength was less than 551 MPa.

Test No. 18 had a cumulative rolling reduction of less than 50%, and therefore the bainite ratio in the mixed structure was small. Therefore, the yield strength was less than 551 MPa.

Test No. 19 had a low finishing temperature for rolling and a low water cooling start temperature, and therefore coarse bainite and cementite were generated. As a result, the yield strength was less than 551 MPa.

Test No. 20 had a low Mn content and therefore the tensile strength was less than 620 MPa. Test Nos. 21 and 23 had Pcm of more than 0.220%, and therefore the surface hardness exceeded 285 Hv. Then, a crack formed in a y-slit type weld cracking test. Test Nos. 22 and 24 each had Pcm of less than 0.180% and therefore the tensile strength was less than 620 MPa.

Although the present invention has been described and illustrated in detail, it is clearly understood that the same is by way of illustration and example only and is not to be taken by way of limitation. The invention may be embodied in various modified forms without departing from the spirit and scope of the invention.

INDUSTRIAL APPLICABILITY

A high-tensile steel plate and a welded steel pipe according to the invention are applicable as a line pipe and a pressure chamber and can be particularly advantageously applied as a line pipe used to transport natural gas or crude oil in a cold region.

The invention claimed is:

1. A high-tensile steel plate comprising 0.02% to 0. 1% C, at most 0.6% Si, 1.6% to 2.5% Mn, 0.1% to 0.7% Ni, 0.01% to 0.1% Nb, 0.005% to 0.03% Ti, at most 0.1% sol. Al, 0.001% to 0.006% N, 0% to 0.0025% B, 0% to 0.6% Cu, 0% to 0.8% Cr, 0% to 0.6% Mo, 0% to 0.1% V, 0% to 0.006% Ca, 0% to 0.006% Mg, 0% to 0.03% a rare earth element, at most 0.015% P, and at most 0.003% S, the balance consisting of Fe and impurities, said high-tensile steel plate having:

a carbon equivalent Pcm in Expression (1) in the range from 0.180% to 0.220%;

a surface hardness of at most Vickers hardness of 285;

a ratio of a martensite austenite constituent in the surface layer of at most 10%;

a ratio of a mixed structure of ferrite and bainite on the inner side beyond the surface layer of at least 90%;

a ratio of the bainite in the mixed structure of at least 10%, a lath of the bainite having a thickness of at most 1 μm and a length of at most 20 μm; and a segregation ratio as the ratio of the Mn concentration of a center segregation part to the Mn concentration of a part in a depth equal to ¼ of the thickness of the plate from the surface of at most 1.3.

$$Pcm=C+Si/30+(Mn+Cu+Cr)/20+Ni/60+Mo/15+V/10+5B \quad (1)$$

where the element symbols represent the % by mass of the respective elements.

2. A high-tensile steel plate comprising 0.02% to 0.1% C, at most 0.6% Si, 1.6% to 2.5% Mn, 0.1% to 0.7% Ni, 0.01% to 0.1% Nb, 0.005% to 0.03% Ti, at most 0.1% sol. Al, 0.001% to 0.006% N, 0% to 0.0025% B, 0% to 0.6% Cu, 0% to 0.8% Cr, 0% to 0.6% Mo, 0% to 0.1% V, 0% to 0.006% Ca, 0% to 0.006% Mg, 0% to 0.03% a rare earth element, at most 0.015% P, and at most 0.003% S, the balance consisting of Fe and impurities, said high-tensile steel plate having:

a carbon equivalent Pcm in Expression (1) in the range from 0.180% to 0.220%;

a surface hardness of at most Vickers hardness of 285;

a ratio of a martensite austenite constituent in the surface layer of at most 10%;

a ratio of a mixed structure of ferrite and bainite on the inner side beyond said surface layer of at least 90%;

a ratio of the bainite in the mixed structure of at least 10%, a length of the major axis of cementite precipitate grains in a lath of said bainite of at most 0.5 μm; and a segregation ratio as the ratio of the Mn concentration of the center segregation part to a Mn concentration of a part in a depth equal to ¼ of the thickness of the plate from the surface of at most 1.3.

$$Pcm=C+Si/30+(Mn+Cu+Cr)/20+Ni/60+Mo/15+V/10+5B \quad (1)$$

where the element symbols represent the % by mass of the respective elements.

3. The high-tensile steel plate according to claim 2, wherein a thickness of the lath is at most 1 μm and a length of the lath is at most 20 μm.

4. A welded steel pipe or tube produced using a high-tensile steel plate, said high-tensile steel plate comprising 0.02% to 0.1% C, at most 0.6% Si, 1.6% to 2.5% Mn, 0.1% to 0.7% Ni, 0.01% to 0.1% Nb, 0.005% to 0.03% Ti, at most 0.1% sol. Al, 0.001% to 0.006% N, 0% to 0.0025% B, 0% to 0.6% Cu, 0% to 0.8% Cr, 0% to 0.6% Mo, 0% to 0.1% V, 0% to 0.006% Ca, 0% to 0.006% Mg, 0% to 0.03% a rare earth element, at most 0.015% P, and at most 0.003% S, the balance consisting of Fe and impurities, said high-tensile steel plate having:

a carbon equivalent Pcm in Expression (1) in the range from 0.180% to 0.220%;

a surface hardness of at most Vickers hardness of 285;

a ratio of a martensite austenite constituent in the surface layer of at most 10%;

a ratio of a mixed structure of ferrite and bainite on the inner side beyond the surface layer of at least 90%;

a ratio of the bainite in the mixed structure of at least 10%, a lath of the bainite having a thickness of at most 1 μm and a length of at most 20 μm; and a segregation ratio as the ratio of the Mn concentration of a center segregation part to the Mn concentration of a part in a depth equal to ¼ of the thickness of the plate from the surface of at most 1.3.

$$Pcm=C+Si/30+(Mn+Cu+Cr)/20+Ni/60+Mo/15+V/10+5B \quad (1)$$

where the element symbols represent the % by mass of the respective elements.

5. A welded steel pipe or tube produced using a high-tensile steel plate, said high-tensile steel plate comprising 0.02% to 0.1% C, at most 0.6% Si, 1.6% to 2.5% Mn, 0.1% to 0.7% Ni, 0.01% to 0.1% Nb, 0.005% to 0.03% Ti, at most 0.1% sol. Al, 0.001% to 0.006% N, 0% to 0.0025% B, 0% to 0.6% Cu, 0% to 0.8% Cr, 0% to 0.6% Mo, 0% to 0.1% V, 0% to 0.006% Ca, 0% to 0.006% Mg, 0% to 0.03% a rare earth element, at most 0.015% P, and at most 0. 003% S, the balance consisting of Fe and impurities, said high-tensile steel plate having:

a carbon equivalent Pcm in Expression (1) in the range from 0.180% to 0.220%;

a surface hardness of at most Vickers hardness of 285;

a ratio of a martensite austenite constituent in the surface layer of at most 10%;

a ratio of a mixed structure of ferrite and bainite on the inner side beyond said surface layer of at least 90%;

a ratio of the bainite in the mixed structure of at least 10%, a length of the major axis of cementite precipitate grains in a lath of said bainite of at most 0.5 μm; and a segregation ratio as the ratio of the Mn concentration of the center segregation part to a Mn concentration of a part in a depth equal to ¼ of the thickness of the plate from the surface of at most 1.3.

$$Pcm=C+Si/30+(Mn+Cu+Cr)/20+Ni/60+Mo/15+V/10+5B \quad (1)$$

where the element symbols represent the % by mass of the respective elements.

6. The welded steel pipe or tube according to claim 5, wherein a thickness of the lath is at most 1 μm and a length of the lath is at most 20 μm.

7. A method of manufacturing a high-tensile steel plate, comprising the steps of:

continuously casting molten steel into a slab, said molten steel comprising:

0. 02% to 0.1% C, at most 0.6% Si, 1.6% to 2.5% Mn, 0.1% to 0.7% Ni, 0.01% to 0.1% Nb, 0.005% to 0.03% Ti, at most 0.1% sol. Al, 0.001% to 0.006% N, 0% to 0.0025% B, 0% to 0.6% Cu, 0% to 0.8% Cr, 0% to 0.6% Mo, 0% to 0.1% V, 0% to 0.006% Ca, 0% to 0.006% Mg, 0% to 0.03% a rare earth element, at most 0.015% P, and at most 0.003% S, the balance consisting of Fe and impurities, said molten steel having a carbon equivalent Pcm in Expression (1) in the range from 0.180% to 0.220%; and rolling said slab into said high-tensile steel plate, said step of casting including the steps of:

injecting said molten steel into a cooled cast and forming said slab having a solidified shell on the surface and unsolidified molten steel inside, drawing said slab downwardly from said cast;

reducing said slab by at least 30 mm in the thickness-wise direction in a position upstream of the final solidifying position of said slab where the center solid phase ratio of said slab is more than 0 and less than 0.2; and carrying out electromagnetic stirring to said slab so that said unsolidified molten steel is let to flow in the width-wise direction of said slab in a position at least 2 m upstream of said reducing position, said step of rolling including the steps of:

heating said slab in the range from 900° C. to 1200° C.;

rolling said heated slab into said steel plate so that the cumulative rolling reduction in an austenite no-recrystallization temperature range is in the range from 50% to 90%; and cooling said steel plate at a cooling rate in the range from 10° C./sec to 45° C./sec from a temperature of at least $A_{r3}$-50° C.

$$Pcm=C+Si/30+(Mn+Cu+Cr)/20+Ni/60+Mo/15+V/10+5B \quad (1)$$

where the element symbols represent the % by mass of the respective elements.

8. The method of manufacturing a high-tensile steel plate according to claim 7, further comprising the step of tempering said steel plate after the cooling at a temperature less than point $A_{c1}$.

9. A method of producing a slab for a high-tensile steel plate using a continuous casting device, comprising the steps of:

injecting molten steel into a cooled cast and forming a slab having a solidified shell on the surface and unsolidified molten steel inside, said molten steel comprising 0.02% to 0.1% C, at most 0.6% Si, 1.6% to 2.5% Mn, 0.1% to 0.7% Ni, 0.01% to 0.1% Nb, 0.005% to 0.03% Ti, at most 0.1% sol. Al, 0.001% to 0.006% N, 0% to 0.0025% B, 0% to 0.6% Cu, 0% to 0.8% Cr, 0% to 0.6% Mo, 0% to 0.1% V, 0% to 0.006% Ca, 0% to 0.006% Mg, 0% to 0.03% a rare earth element, at most 0.015% P, and at most 0.003% S, the balance consisting of Fe and impurities, the carbon equivalent Pcm in Expression (1) being from 0.180% to 0.220%;

drawing said slab downwardly from said cast;

reducing said slab by at least 30 mm in the thickness-wise direction in a position upstream of the final solidifying position of said slab where the center solid phase ratio of said slab is more than 0 and less than 0.2; and carrying out electromagnetic stirring to said slab so that said unsolidified molten steel is let to flow in the width-wise direction of said slab in a position at least 2 m upstream of said reducing position, $$Pcm=C+Si/30+(Mn+Cu+Cr)/20+Ni/60+Mo/15+V/10+5B \quad (1)$$

where the element symbols represent the % by mass of the respective elements.

* * * * *